US005797861A

United States Patent [19]

Port

[11] Patent Number: 5,797,861

[45] Date of Patent: Aug. 25, 1998

[54] BACK REST PARTICULARLY USEFUL FOR PRODUCING A SHIATSU MASSAGING EFFECT IN THE LUMBAR REGION

[75] Inventor: Israel Port, Ramat Gan, Israel

[73] Assignee: Concept Product Promotion Ltd., Tel Aviv, Israel

[21] Appl. No.: 661,949

[22] Filed: Jun. 12, 1996

[30] Foreign Application Priority Data

Jun. 13, 1995 [IL] Israel ..... 114136

[51] Int. Cl.[6] ..... A61H 7/00

[52] U.S. Cl. ..... 601/134; 297/452.45; 297/452.47; 601/138

[58] Field of Search ..... 601/134, 136, 601/138; 5/482, 737; 297/219.1, 452.32, 452.63, 452.6, 452.56, 452.47, 452.45

[56] References Cited

U.S. PATENT DOCUMENTS 3,381,999 5/1968 Steere, Jr. ..... 297/452.47
4,529,248 7/1985 Trotman et al. ..... 297/452.45

*Primary Examiner*—Robert A. Hafer
*Assistant Examiner*—Benjamin K. Koo
*Attorney, Agent, or Firm*—Ladas & Parry

[57] ABSTRACT

This invention discloses a back rest, including a body member formed with a back-facing side to face the back of a user, and a plurality of spaced projections projecting from the back-engageable face to engage the back of user at a plurality of discrete points, each of the projections being stiff, formed with a rounded outer surface to contact the user's back, and circumscribed by a relatively flat surface, such that the projections produce a Shiatsu local massaging effect on the user's back.

2 Claims, 3 Drawing Sheets

FIG. 1
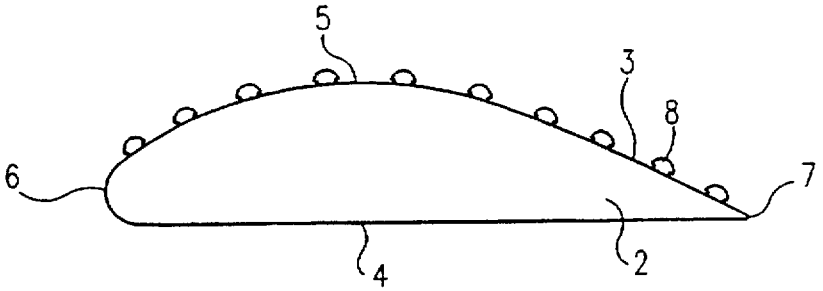
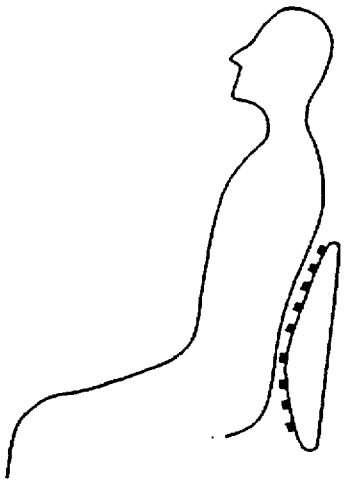
FIG. 4A
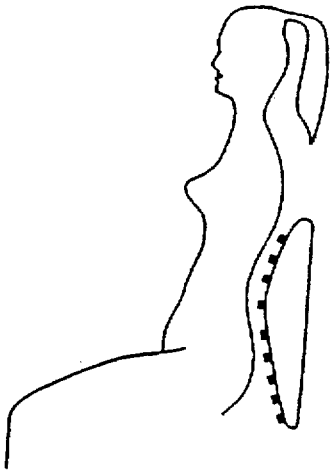
FIG. 4B
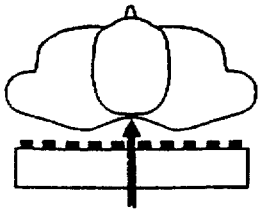
FIG. 4C
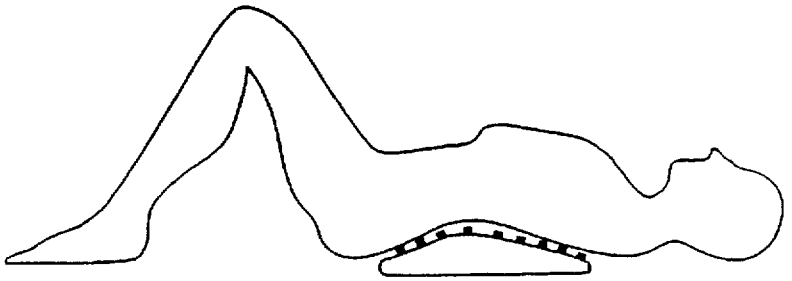
FIG. 4D 6a
5a
16a
15a
14a
8a
7a
11

6b
5b
16b
15b
14b
8b
7b
12

6c
5c
15c
16c
15c
13
7c

BACK REST PARTICULARLY USEFUL FOR PRODUCING A SHIATSU MASSAGING EFFECT IN THE LUMBAR REGION

The present invention relates to a back rest or back support for supporting the back of a user. The invention is particularly useful as a back rest for producing a Shiatsu massaging effect in the lumbar region of a user, and is therefore described below with respect to this application.

Backaches are an extremely common complaint, and it is estimated that, next to the common cold, they are probably the most frequent cause for absenteeism from employment. Backaches may be caused by various disorders associated with muscles, ligaments, bones or nerves. A wide variety of different constructions and configurations of back rests have been developed and are available to prevent or treat backaches, but nevertheless backaches continue to be a common complaint.

An object of the present invention is to provide a back rest of a novel construction.

According to a broad aspect of the present invention, there is provided a back rest comprising a body member formed with a back-facing side to face the back of a user; and a plurality of spaced projections projecting from the back-engageable face to engage the back of user at a plurality of discrete points. Each of the projections are stiff, formed with a rounded outer surface to contact the user's back, and circumscribed by a relatively flat surface, such that the projections produce a Shiatsu local massaging effect on the user's back.

The local massaging effect produced by such a back rest is thus similar to the massaging effect produced by the application of semi-flexible finger pressure to local discrete areas in the Shiatsu technique for treating a person's body. In fact, preliminary trial uses of back rests constructed in accordance with the invention have indicated that the back rest produces similar beneficial effects as a Shiatsu massage.

According to further features in the preferred embodiment of the invention described below, the back-facing side of the body member is formed with a convexly-curved contour conforming to the curvature of the lumbar region of a person, the convexly-curved contour being closer to one end of the body member than to the other end. The back rest may thus be placed in one position with the convexly-curved contour adjacent to the bottom of the back rest for use by males or by shorter persons, or in the opposite position with the convexly-curved contour adjacent to the top of the back rest for use by females or by taller persons. Best results have been obtained when the projections are of semi-cylindrical configuration and when the projections are arranged in a plurality of parallel lines, with the projections of each line staggered with respect to those of the adjacent lines.

According to further features in the described preferred embodiment, the back rest includes an outer covering formed with a plurality of openings in the back-facing side thereof, and a plurality of inserts receivable within the outer covering and formed with the projections projecting through the openings. In the described embodiment, the inserts are in the form of strips of stiff resilient material, such as expanded polyethylene, in side-by-side relationship within the outer covering. The strips include a first type formed with the projections, and a second type alternating with those of the first type and also formed with the projections but in staggered relationship with respect to the projections of the first type. The strips also include a third type devoid of projections, one of the third type alternating with each of those of the first and second types to serve as spacers between the strips of the first and second types and their projections.

Further features and advantages of the invention will be apparent from the description below.

The invention is herein described, by way of example only, with reference to the accompanying drawings, wherein:

FIG. 1 is a side elevational view illustrating one form of back rest constructed in accordance with the present invention;

Figure 2:
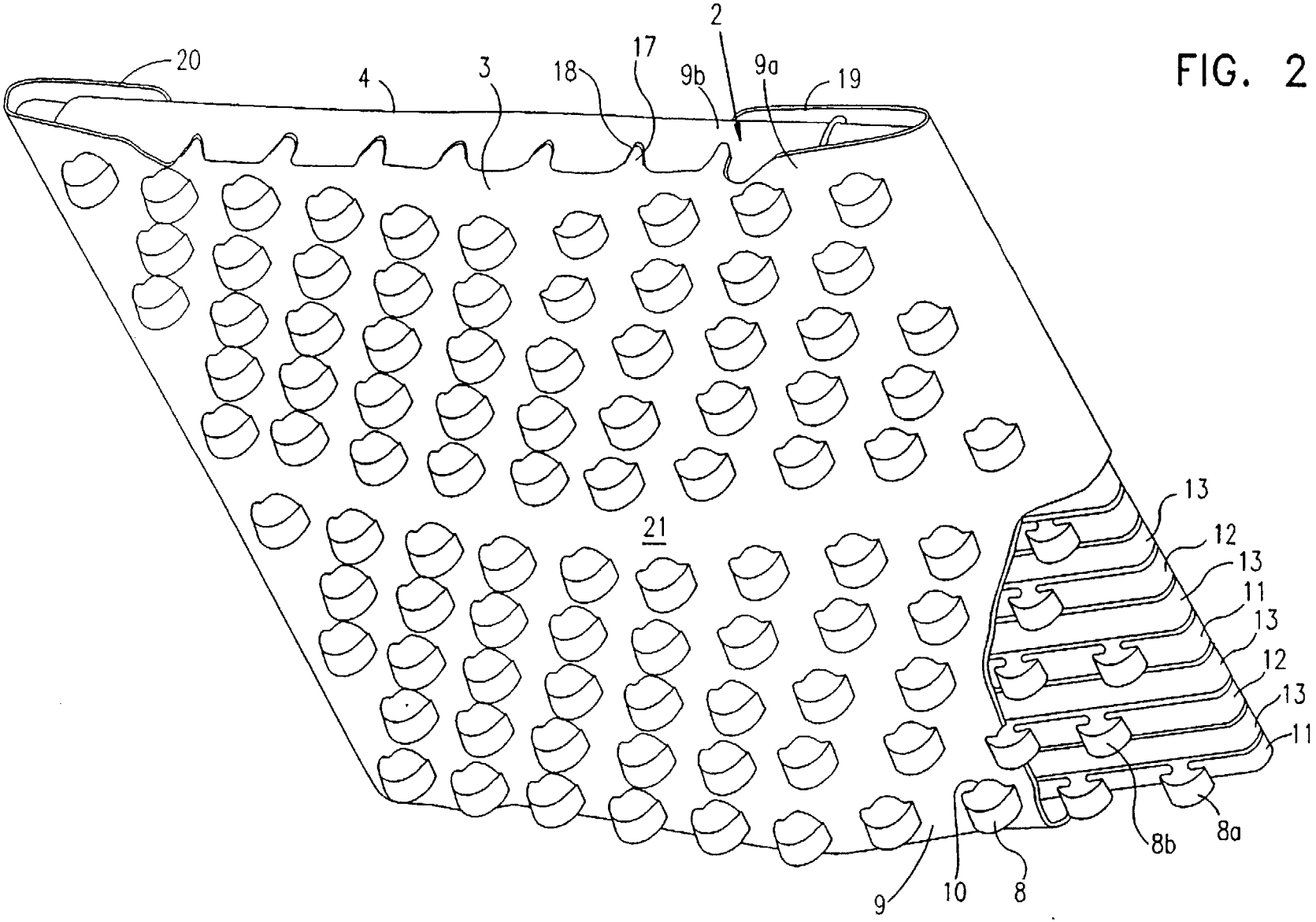
FIG. 2 is an enlarged three-dimensional view, with parts broken away to show internal structure, of one form of back rest construction in accordance with the present invention.
Figures 3A, 3B, 3C:
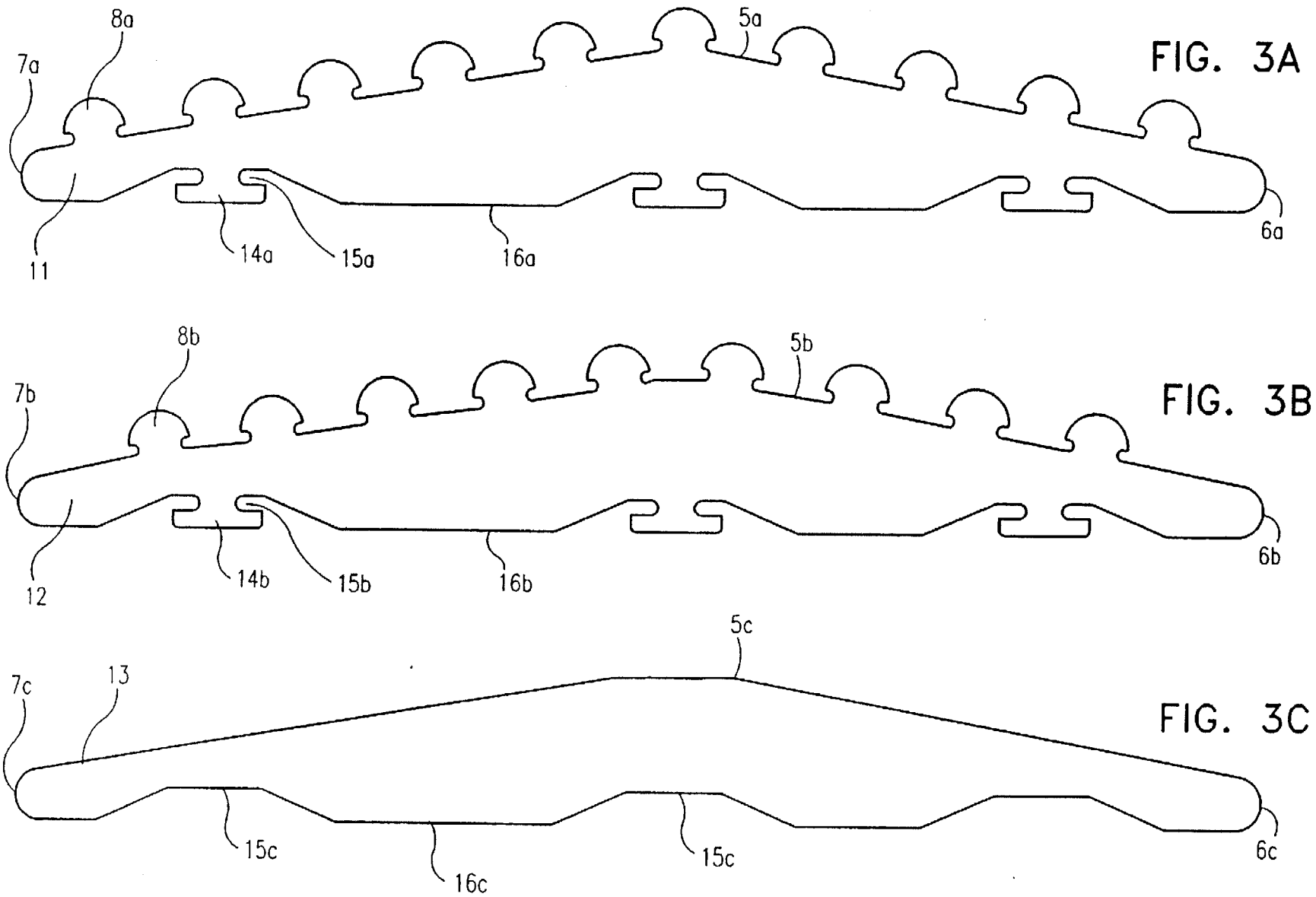

FIGS. 3*a*, 3*b* and 3*c* are side-elevational views illustrating the three types of inserts included in the back rest of FIG. 2;

FIG. 4*a* illustrates how the back rest of FIGS. 1 and 2 may be used for supporting the lumbar region of a male in a sitting position;

FIG. 4*b* illustrates how the back rest of FIGS. 1 and 2 may be used for supporting the lumbar region of a female in a sitting position;

and FIGS. 4*c* and 4*d* are end and side views, respectively, illustrating how the back rest of FIGS. 1 and 2 may be used for supporting the lumbar region of a male in a reclining position.

The back rest or back support illustrated in FIGS. 1 and 2 is constructed particularly for use in supporting the lumbar region of a person and for producing a Shiatsu massage to that region. It includes a body member 2 formed with a broad, back-facing side 3 to face the back of the user, and with a relatively flat opposite side 4 for engagement with a relatively flat supporting surface, such as the back of a chair or seat when supporting the user in a sitting position (FIGS. 4*a*, 4*b*), or a floor when supporting the user in a reclining position (FIGS. 4*c*, 4*d*).

The back-facing side 3 is formed with a convexly-curved contour 5 conforming to the curvature of the lumbar region of a person. As shown in FIG. 1, this curved contour 5 is closer to one end 6 of the body member 2 than to the opposite end 7. Thus, when the back rest is to be used for supporting the lumbar region of a male, or of a shorter person, in a sitting position, the back rest would be oriented as shown in FIG. 4*a* with the convexly-curved contour 5 at the bottom of the back rest; whereas if it is to be used for supporting a female, or a taller person, in a sitting position, the back rest would be oriented with the convexly-curved contour 5 at the upper end as shown in FIG. 4*b*.

The body member 2 includes a plurality of spaced projections 8 projecting from the back-facing side 3 to engage the back of a user at a plurality of discrete points. Each of these projections 8 is stiff but resilient, is completely circumscribed by a relatively flat surface, and is formed with a rounded outer surface to contact the user's back such as to produce local massaging effects, similar to a "Shiatsu" finger massage, on the user's back.

FIG. 2 more particularly illustrates the construction of the back rest of FIG. 1. It includes an outer covering 9 formed with a plurality of openings 10 in the back-facing side 3, and a plurality of inserts 11, 12, 13 received within the outer covering 9 and formed with the projections 8 projecting through the openings 10.

The inserts 11, 12, 13 are in the form of strips of three different types, as illustrated in FIGS. 3*a*, 3*b* and 3*c*, respectively. Thus, strips 11 are formed with a plurality of projections 8*a* on one side and with other projections 14*a* on the opposite side. Strips 12 are similarly formed with a plurality of projections 8*b* on one side and with other projections 14*b* on the opposite side, but the projections 8*b* are staggered with respect to the projections 8*a*. Strips 13 are devoid of projections and serve as spacer strips between a pair of adjacent strips 11 and 12.

As shown in FIG. 2, each of the projections 8*a*, 8*b* is of substantially semi-cylindrical configuration. All the strips 11, 12, 13 are aligned in side-by-side relation within the outer covering 3, with strips 11 alternating with respect to strips 12, and with a spacer strip 13 interposed between each of the strips 11, 12 and the next adjacent strip 11, 12. Thus, projections 8*a* and 8*b* of the two types of strips 11 and 12 form a plurality of spaced, parallel lines of projections, with the projections of each line circumscribed by a relatively flat surface and staggered with respect to those of the adjacent lines. Such an arrangement not only uniformly distributes the discrete contact points where the massaging effects are produced, but also facilitates the circulation of air between side 3 of the back rest and the user's back.

The projections 14*a*, 14*b* on the opposite sides of the two types of strips 11, 12 are fewer in number than projections 8*a* and 8*b*, and are passed through corresponding openings in the opposite side 4 of the outer covering 9 to more securely hold the strips within the outer covering. In order to maintain side 4 relatively flat, each projection is circumscribed by an annular recess 15*a*, 15*b* for receiving the outer covering 9. In addition, the outer face of each projection 14*a*, 14*b* is flat and is substantially flush with the outer face 16*a*, 16*b* of the remainder of the strips 11, 12.

The spacer strips 13 include neither types of projections, but rather are formed with recesses 15*c* alignable with the recesses 15*a*, 15*b*, and flat faces 16*c* alignable with flat faces 16*a*, 16*b*, in the stacked assembly of strips 11–13.

The two faces of the strips 11, 12, 13, determine the configuration of the back-facing side 3 and the opposite side 4, respectively, of the body member 2. Thus, each of the strips 11, 12, 13 is formed on one face with a convexly-curved contour, as shown at 5*a*, 5*b* and 5*c*, respectively, defining the lumbar-region contour 5 of the body member 2 conforming to the curvature of the lumbar region of a person. As mentioned above, the curved contour 5 is closer to one end (6*a*, 6*b*, 6*c*) than to the opposite end (7*a*, 7*b*, 7*c*) of the strips, which ends define the respective ends 6, 7 of the body member. The opposite faces 16*a*, 16*b*, 16*c* of the strips 11, 12, 13 are relatively flat, except for the above-described recesses 15*a*, 15*b*, 15*c* to define the substantially flat face 4 of the body member 2.

The inserts 11, 12, 13 are formed of a stiff but resilient expanded plastic material, such as foamed polyethylene, foamed rubber, etc. The outer covering 9 is of two sheets 9*a*, 9*b* of a plastic material, such as polyethylene, polyurethane, polyvinylchloride, etc. The two sheets are secured together at their respective edges to form the cover by tongues 17 in the edge of one sheet receivable within openings 18 in the respective edge of the other sheet. The opposite ends of sheet 9*a* include extensions permitting them to be turned over as flaps 19, 20 to cover the opposite ends of sheet 9*b*.

As shown in FIG. 2, the central area 21 of the back-facing side 3 of the back rest is devoid of projections so that local pressure is not applied to the spinal cord of the user. Spacer strips 13 (FIG. 3), which are devoid of projections, would be used in region 21.

FIGS. 4*a*–4*d* illustrate examples of how the back rest may be used particularly for supporting the lumbar region of a person. Thus, as shown in FIG. 4*a*, when the back rest is used for a male (or a shorter person) in a sitting position, the body member 2 is oriented with the lumbar-region contour 5 towards the lower end; and as shown in FIG. 4*b*, when the back rest is to be used for supporting the lumbar region of a female (or a taller person) in a sitting position, the body member 2 is oriented in the opposite direction with the lumbar-region contour 5 at the upper end. FIGS. 4*c* and 4*d* illustrate the orientation of the body member 2 when supporting a male in the reclining position. It will be appreciated that when used for supporting a female in a reclining position, the lumbar-supporting contour 5 will be oriented in the opposite direction, as shown in FIG. 4*b*.

While the invention has been described with respect to one preferred embodiment, it will be appreciated that this is set forth merely for purposes of example, and that many variations may be made. For example, the back rest could be produced of a single plastic material integrally molded in a one-shot process for producing also the projections 8. In addition, the projections 8 may take other configurations, such as spherical or semi-spherical configurations. Many other variations, modifications and applications of the invention may be made.

I claim:

1. A back rest comprising:

a plurality of discrete elements, each having a uniform thickness and defining at least one edge;

a multiplicity of mutually spaced protrusions integrally formed with said discrete elements and having said uniform thickness, extending outwardly at said at least one edge; and a combination joining and covering element comprising a portion of semi-flexible web material having apertures therein, said web material tightly engaging said plurality of discrete elements, whereby said apertures are stretched over said protrusions, said protrusions extend through said apertures, and retaining said plurality of discrete elements in generally parallel registration.

2. A back rest according to claim 1 and also comprising a plurality of spacer elements having a configuration similar to said plurality of discrete elements but lacking at least some of said multiplicity of protrusions, at least one of said spacer elements being disposed intermediate each pair of said plurality of discrete elements.

* * * * *